United States Patent [19]

Tersiev et al.

[11] Patent Number: 4,854,067

[45] Date of Patent: Aug. 8, 1989

[54] HYDROPNEUMATIC HARPOON

[75] Inventors: Kostadin G. Tersiev; Mitko V. Kamenov, both of Sofia, Bulgaria

[73] Assignee: Stiemge, Sofia, Bulgaria

[21] Appl. No.: 215,692

[22] Filed: Jul. 6, 1988

[51] Int. Cl.[4] ..... A01K 81/04

[52] U.S. Cl. ..... 43/6

[58] Field of Search ..... 43/5, 6

[56] References Cited

U.S. PATENT DOCUMENTS

| | | | |
|---|---|---|---|
| 3,090,151 | 5/1963 | Stewart et al. | 43/6 |
| 3,419,991 | 1/1969 | Mitchell | 43/6 |
| 4,651,454 | 3/1987 | Harris | 43/6 |
| 4,660,315 | 4/1987 | Ferro | 43/6 |

*Primary Examiner*—M. Jordan

*Attorney, Agent, or Firm*—Klein & Vibber

[57] ABSTRACT

A hydropneumatic harpoon has an arrow, a base and a body with a hydraulic chamber. In the rear end of the chamber is a pneumoaccumulator, the front of which rests against a rubber membrane whose front part is placed on a discharge grid while its rear part is mounted on a mobile barrel that is sealed by a rubber ring. Perpendicularly to the axis of the discharge grid is mounted a trigger valve. The barrel is connected through intermediate barrels with an attachment in which is placed a seal for the arrow. The arrow is composed of a basic stem and a point that are connected through one or more intermediate stems. The inner diameter of the barrel and those of the intermediate barrels are equal. The diameter of the basic stem and the diameters of the intermediate stems are also equal. A principal advantage of this harpoon is the ability to modify its length and thus to obtain a harpoon with a small, medium or large killing force when used in submarine fishing.

4 Claims, 2 Drawing Sheets

HYDROPNEUMATIC HARPOON

FIELD OF THE INVENTION

The invention refers to a hydropneumatic harpoon used in submarine fishing.

BACKGROUND OF THE INVENTION

A known hydropneumatic harpoon is disclosed in Bulgarian Inventor's Certificate BG 32725. The known device comprises an arrow, base and body in which is mounted a hydraulic chamber and in the rear end of which is screwed the pneumoaccumulator body. The front of the pneumoaccumulator rests against a rubber membrane with which are sealed the pneumoaccumulator and the hydraulic chamber. The front end of the rubber membrane is set against a discharging grid while the extension is mounted on a mobile barrel. The rear end of the pneumoaccumulator is closed by a bottom. The rear half of the mobile barrel operates at the same time as a cut-off valve, the sealing edge of which rests against a rubber ring. The rubber ring is mounted on the base that is screwed in the front end of the hydraulic chamber. A barrel is also screwed to the base. The seat of the trigger valve is mounted perpendicularly to the longitudinal axis of the discharge grid and is closed under the action of a spring. In the discharge grid there is an opening which connects the rear valve volume with the volume formed over the trigger valve.

A disadvantage of this known hydropneumatic harpoon is that it is manufactured in different lengths depending on the fish dimension for which it is destined since the killing force of the arrow is depending directly on its length. In the harpoon art, three types of harpoon lengths are generally used: small (up to 0.5 m), medium (from 0.7 to 1.4 m) and large (over 1.5 m). From a harpoon with a given length, only an arrow with a fixed diameter can be shot, thus imposing to manufacture items with different arrow diameters depending on conditions under which there are used e.g., sand or stone bottom etc.

SUMMARY OF THE INVENTION

An object of this invention is to provide for a hydropneumatic harpoon with a regulable barrel length in which all three types of dimensions are combined whereby arrows with different lengths and diameters can be shot.

This object is attained by a hydropneumatic harpoon comprising an arrow, a body with mounted therein base and hydraulic chamber. A pneumoaccumulator body is screwed to the hydraulic chamber, and the volume of the pneumoaccumulator body is separated from the volume of the hydraulic chamber by a rubber membrane. The front end of the rubber membrane is placed on a discharge grid while its extension lies on a mobile barrel. The rear part of the mobile barrel is established in a movable manner in an axial direction with regard to the base and the discharge grid and it rests against a rubber ring that is fixed between the base and the hydraulic chamber. To the front end of the barrel is screwed another barrel. According to this invention it is connected through intermediate barrels with an attachment in which is placed the arrow sealing. The intermediate barrels are connected with the barrel and between themselves by means of transitional elements.

The arrow comprises a basic stem and a point which are connected by intermediate stems. The inner diameter of the barrel and the inner diameters of the intermediate barrels are equal. The diameters of the basic stem and the diameters of the intermediate stems are also equal.

An advantage of this invention is the ability to modify the length of the hydropneumatic harpoon thus permitting one item, depending on the needs, to serve as a harpoon with a small, medium or large killing force of the shot. It is possible to use arrows with a different diameter in changing the seal, the inner diameter of which is coordinated with the diameter of the arrow. The killing force of the arrow can also be regulated by means of a secondary charging of the arrow.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
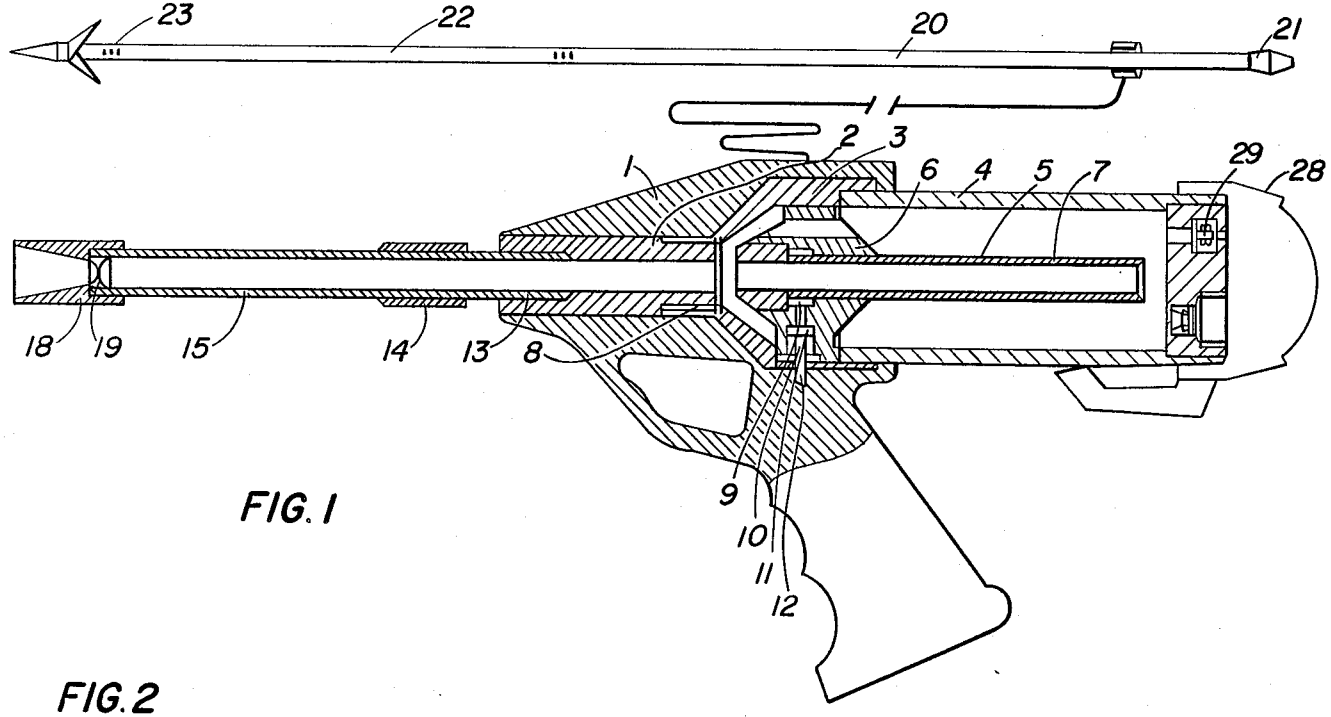
FIG. 1 represents a partial section of the harpoon and arrow.

Referring first to FIG. 1, the hydropneumatic harpoon comprises a body 1 in which is mounted a base 2 and hydraulic chamber 3. A pneumoaccumulator body 4 is screwed to the hydraulic chamber 3 and the volume of the body 4 is separated from the volume of the hydraulic chamber 3 by a rubber membrane 5. The front end of the rubber membrane 5 is placed on a discharge grid 6 while its extension lies on the rear part of a mobile barrel 7. This barrel 7 is mounted movably in an axial direction with regard to hydraulic chamber 3 and discharge grid 6 and it rests against a rubber ring 8. This ring 8 is placed between the base 2 and hydraulic chamber 3 so that a rear-valve volume 9 is formed that is connected through opening 10 with volume 11 which is disposed over trigger valve 12.

Figure 3A:
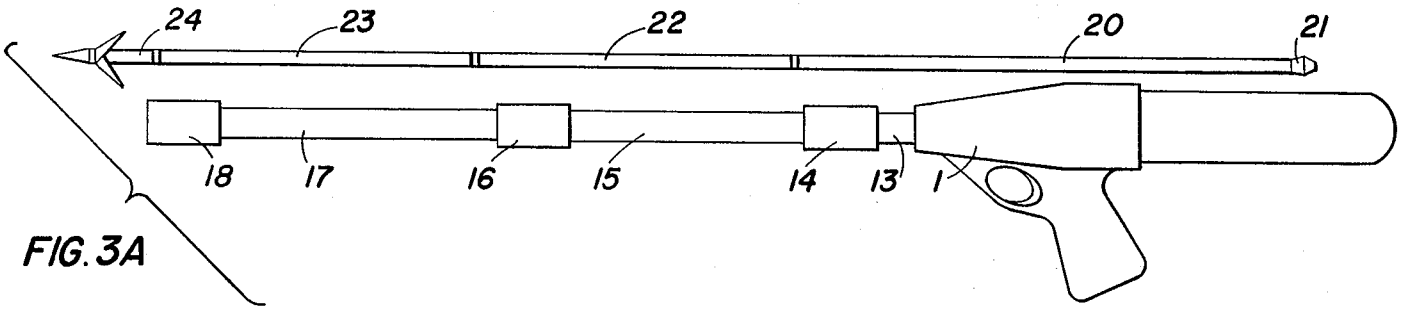
FIGS. 3A, 3B, and 3C is a series of exemplary embodiments of the hydropneumatic harpoon with varying lenths, shown in side elevation. 3A has two extensions, 3B has one extension, and 3C has no extension.
Figure 3B:
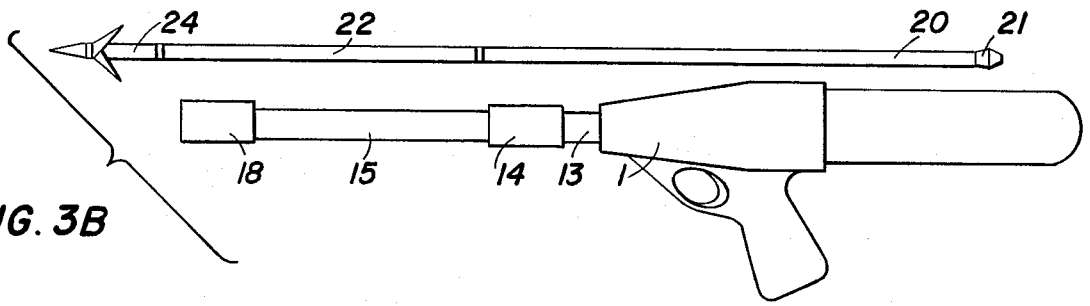
Figure 3C:
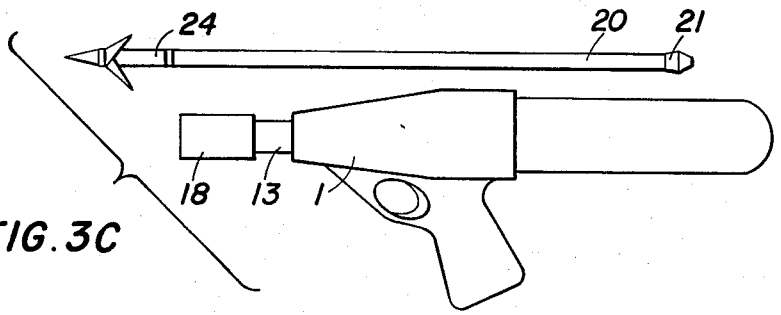

Referring now to FIG. 3, the longest embodiment shows barrel 13 screwed to the front end of base 2, and the front part of barrel 13, through a transitional element 14, screwed to an intermediate barrel 15. The free end of intermediate barrel 15, through a second transitional element 16, is wound to a second intermediate barrel 17. Through an attachment 18, a seal 19 of the arrow is fastened to second intermediate barrel 17.

The arrow comprises a basic stem 20 with a conic widening 21 in its rear end. The front end of the basic stem 20 is screwed to an intermediate stem 22. The free end of stem 22 is screwed to a second intermediate stem 23 and to it the point 24 of the arrow. The inner diameters of intermediate barrels 15 and 17 are equal as well as the diameters of intermediate stems 22 and 23.

Figure 2:
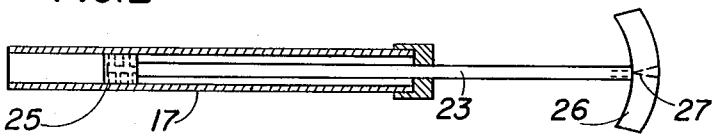
FIG. 2 is a section of the pump formed by the intermediate barrel of the harpoon.

As shown in FIG. 2, the intermediate barrel 17 can be used as a pump cylinder and in it is inserted a plunger 25 that is connected with the intermediate stem 23 of the arrow whereas to the other end of the stem is screwed a handle 26 for pumping. The handle 26 unscrewed from intermediate stem 23 is connected with its conic opening 27 with point 24 of the arrow.

Referring once again to FIG. 1, the inner diameter of the seal 19 that is mounted in the front barrel 15 corresponds to the diameter of the arrow and the outer diameter of the seal 19 corresponds to the conic widening 21 at the end of the arrow. At the rear end of the pneumoaccumulator 4 is screwed a bottom 28 in which are disposed a protective valve 29 and a pressure valve 30. The pressure valve 30 is connected with a threaded opening.

MANNER OF OPERATION

The harpoon according to the invention operates as follows:

Initially the pressure in pneumoaccumulator 4 is increasing by means of intermediate barrel 17 screwed in opening 31 whereby handle 26 attached to intermediate stem 23 with plunger 25 is moved axially along the pump axis in a manual manner. When the pressure is pneumoaccumulator 4 has increased until the protective valve 29 indicates maximal pressure of air within the pneumoaccumulator 4, the harpoon is ready for shooting.

Depending on the selected lengths of the harpoon and the arrow, the latter is inserted through seal 19 in the barrel that is filled with water. Handle 26 is unscrewed from intermediate stem 23 and its conic opening 27 is placed on point 24 of the arrow. The arrow is then inserted into the barrel whereby the rear part of mobile barrel 7, sealed in rubber ring 8, is displaced axially backwards and through the formed slit and the openings in discharge grid 6. Water flows in the interspace between the rear part of mobile barrel 7 and rubber membrane 5.

When the action on point 24 of the arrow is discontinued, the rear part of mobile barrel 7 is again sealed in rubber ring 8 under the action of rubber membrane 5 and the air pressure in pneumoaccumulator 4. No other force acts on the arrow except the radial force of friction generated in the place of contact between the arrow and the seal 19.

On pressing of the trigger, valve 12 is opened and pressure in rear-valve volume 9 decreases abruptly. The rear part of mobile barrel 9 moves backward, whereby, the water introduced during the charging of the arrow flows out under the action of air pressure from the pneumoaccumulator 4 through the openings in discharge grid 6 and the volume of the barrel. The arrow begins moving forward with a great velocity in order to release free space for the water. After the arrow has left the barrel, the rear part of mobile barrel 7 is closed again in rubber ring 8.

It is also possible, once the arrow had been inserted in the barrel, to take it out of the barrel and re-insert it so that the amount of water penetrating between rubber membrane 5 and the rear part of mobile barrel 7 is increased two times, thus augmenting the pressure in pneumoaccumulator 4 and, as a result, increasing the killing force. The increase of the pressure is limited by the protective valve 29.

In case a more powerful harpoon is required, one may augment the size of the barrel and the arrow. This is accomplished by adding to intermediate barrel 15, by means of transitional element 16, intermediate barrel 17 and fastening to its front end, by means of attachment 18, the seal 19. Correspondingly, the arrow is lengthened by adding to the free end of intermediate stem 2 of the arrow intermediate stem 23 to the free end of which is fixed the point 24 of the arrow.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A hydropneumatic harpoon comprising an arrow, a base and a body, said body having a hydraulic chamber;

said hydraulic chamber having a rear portion with a pneumoaccumulator, and a front portion with a rubber membrane;

said rubber membrane having a front part placed on a discharge grid and a rear part mounted on a mobile barrel;

a rubber ring between the base and the front part of the hydraulic chamber;

a barrel attached to said base, and a trigger valve mounted perpendicularly to the axis of said discharge grid;

said barrel being extensible by connection with an intermediate barrel, said intermediate barrel and said barrel end with an attachment containing an arrow seal, said intermediate barrel and said barrel being connectible to each other by means of a transitional element;

said arrow comprising a stem and being similarly extensible by connection with an intermediate stem, said stem and said intermediate stem being connectable to an arrow point.

2. A hydropneumatic harpoon, as claimed in claim 1, wherein said barrel and said intermediate barrel have equal inner diameters.

3. A hydropneumatic harpoon, as claimed in 1, wherein said stem and said intermediate stem have equal diameters.

4. A hydropneumatic harpoon comprising an arrow, a base and a body, said body having a hydraulic chamber;

said hydraulic chamber having a rear portion with a pneumoaccumulator, and a front portion with a membrane;

said membrane having a front part placed on a discharge grid and a rear part mounted on a mobile barrel;

a sealing means between the base and the front part of the hydraulic chamber;

a barrel attached to said base, and a trigger valve mounted perpendicularly to the axis of said discharge grid;

said barrel being extensible by connection with an intermediate barrel, said intermediate barrel being extensible by connection with another intermediate barrel;

said intermediate barrels and said barrel end with an attachment containing an arrow seal, said intermediate barrels and said barrel being connectible to each other by means of transitional elements;

said arrow comprising a stem and being similarly extensible by connection with an intermediate stem, said intermediate stem being extensible by connection with another intermediate stem;

said stem and said intermediate stems being connectable to an arrow point.

* * * * *